United States Patent [19]

Boehmer et al.

[11] Patent Number: 4,811,704

[45] Date of Patent: Mar. 14, 1989

[54] VALVE STEM SEAL

[75] Inventors: Dennis A. Boehmer, Xenia; Floyd V. Edwards, Yellow Springs, both of Ohio

[73] Assignee: Vernay Laboratories, Inc., Yellow Springs, Ohio

[21] Appl. No.: 164,690

[22] Filed: Mar. 7, 1988

[51] Int. Cl.[4] ..... F01L 3/08

[52] U.S. Cl. ..... 123/188 P; 277/152

[58] Field of Search ..... 123/188 P, 188 R; 277/152

[56] References Cited

U.S. PATENT DOCUMENTS 3,480,286 11/1969 Kosatka ..... 123/188 P
3,498,621 3/1970 Wilson ..... 277/152
4,125,265 11/1978 Grzesiak ..... 277/
4,198,062 4/1980 Grzesiak ..... 123/188 P
4,317,436 3/1982 Barnhart et al. ..... 123/188
4,531,483 7/1985 Vossieck et al. ..... 123/188 P

FOREIGN PATENT DOCUMENTS 96316 7/1980 Japan ..... 123/188 P

*Primary Examiner*—E. Rollins Cross
*Attorney, Agent, or Firm*—Biebel, French & Nauman

[57] ABSTRACT

A valve stem seal for an intake or an exhaust valve in an internal combustion engine consists of an elastomeric portion, an insert and a retaining member. The elastomeric portion and insert are interconnected and the elastomeric portion has a cylindrical wall engaging the valve stem. Both the elastomeric portion and insert portion are positioned on the top surface of the valve guide boss and retained thereon by a retaining member which engages the boss.

17 Claims, 3 Drawing Sheets

VALVE STEM SEAL

BACKGROUND OF THE INVENTION

The present invention relates generally to means for sealing relative reciprocating members; more particularly, to means for preventing the flow of excess oil along the stem of a valve into a combustion chamber of an internal combustion engine, and specifically, to seals commonly known as valve stem seals.

Internal combustion engines have a plurality of intake and exhaust valves, each comprising a valve head and a stem reciprocally mounted in a valve guide. The valve guide may be an integral part of the cylinder head or block, or may comprise a separate member fitted into the cylinder head or block. The end of the valve stem most remote from the cylinder block is usually engaged by a rocker arm in an overhead valve engine or by a plunger in an L-configured engine. Both the rocker arm and the plunger are cam operated.

Oil is usually supplied to the upper end of the valve stem through an oil splash system or by a localized system through the rocker arm to the point of contact with the end of the valve stem so that the oil runs along the stem to lubricate the stem as it reciprocates within the guide.

As wear occurs in the valve guide or the valve stem, excess oil tends to work through the guide to the head of the valve where it may be drawn either into the combustion chamber, in the case of an intake valve, or through the exhaust port, in the case of an exhaust valve, leading, in either case, to an excess consumption of oil and formation of carbon deposits.

Valve stem seals made of various elastomers have been known for some time, several examples being shown in U.S. Pat. Nos. 3,498,621, 4,125,265 and 4,317,436. Such valve stem seals typically include a one-piece elastomeric member which fits around and on top of the valve stem guide. The one-piece elastomeric member of these valve stems is held in place by a biasing means and the sealing portion of the elastomeric member, which encircles the valve stem, is held in a hugging relationship with the stem by another biasing means.

Alternatively, some conventional valve stem seals have combined retaining means for securing the elastomeric member on top of the valve guide in combination with biasing means for the elastomeric member. Basically, all known embodiments of these prior valve stem seals suffer from the utilization of excessive amounts of expensive elastomeric material in their structure.

Accordingly, there is a need for a valve stem seal which not only can achieve the required performance parameters for oil consumption and wear resistance over the working life of the vehicle engine, but can also be made less expensive by reducing the amount of expensive elastomeric material required in the seals while retaining the superior performance parameters and wear characteristics required in internal combustion engines.

SUMMARY OF THE INVENTION

The present invention provides an improvement in valve stem seals wherein the amount of elastomeric material utilized in the seal is significantly reduced. The space usually occupied by the reduced amount of elastomeric material is replaced by an insert which is operatively connected to the remaining elastomeric material. The insert, for example, may be formed of stamped or powdered metal, molded plastic or ceramics or other suitable material.

The valve stem seal of the present invention consists of an elastomeric portion and a mated insert portion retained in position on top of the valve guide encircling the valve stem by a retainer. The elastomeric portion may contain a groove for receiving a garter spring or wire ring which applies pressure to the internal wall of the elastomeric portion so that it is retained in a frictionally contacting relationship with the valve stem as the stem reciprocates in the internal combustion engine. It may also contain an additional groove for operatively connecting the elastomeric portion with the insert portion. Alternatively, the elastomeric and insert portions may be molded together.

A retainer is utilized to hold the elastomeric and insert portions in position above the valve guide boss about the valve stem. In the preferred embodiment, the internal edge of the internal wall of the elastomeric portion has at least one rib for engaging the valve stem and a plurality of ribs engaging the valve guide boss.

Accordingly, it is a primary objective of the present invention to provide means for sealing relatively reciprocating members; to provide a durable, low cost valve stem seal; to provide a valve stem seal which prevents excess amounts of oil from entering into the combustion chamber of an internal combustion engine; to provide a novel valve stem seal made partially of elastomeric material and partially of other durable but less expensive material; and to provide a valve seal which significantly reduces the amount of elastomeric material used in conventional valve stem seals while maintaining the required wear resistance of the elastomeric material over the working life of the vehicle engine.

Other objects and advantages of the present invention will be apparent from the following description, the accompanying drawings, and the appended claims.

DETAILED DESCRIPTION OF THE DRAWINGS

DETAILED DESCRIPTION OF THE PREFERRED EMBODIMENT

Figure 1:
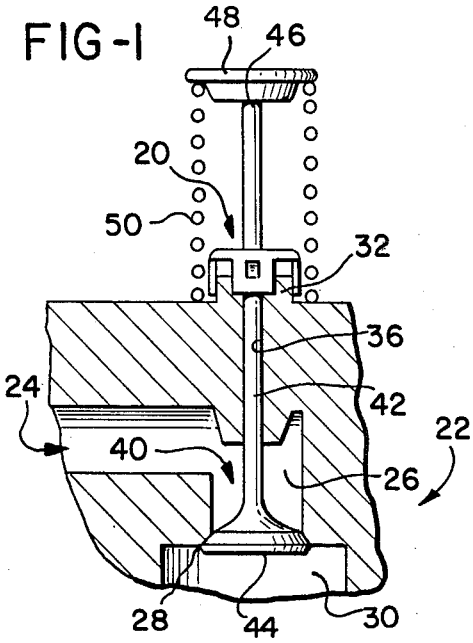
FIG. 1 is a fragmentary side elevation view, partially in cross section, of an overhead valve assembly provided with a valve stem seal of the present invention.

As illustrated in FIG. 1, the valve stem seal 20 of the present invention is shown in its working environment in an internal combustion engine. FIG. 1 shows a portion of a cylinder head 22 for an internal combustion engine such as utilized in an automotive vehicle. The cylinder head 22 has a port 24 which may be either a part of the fuel intake system or part of the exhaust system. The port 24 extends to an opening 26 bounded by a valve seat 28 into a combustion chamber 30. A valve guide boss 32, which either may be an integral part of the cylinder head as shown in FIG. 1, or a separate member suitably secured thereto, is axially aligned with a valve guide 36 opening into the port 24.

A valve 40 has an elongated valve stem 42 received in the guide 36 and the valve guide boss 32 and an enlarged valve head 44 positioned below the opening 26 and sealingly engaging the valve seat 28 to open and close communication between the port 24 in the cylinder head 22 and the combustion chamber 30 as the valve 40 reciprocates. The valve stem 42 projects upwardly beyond the top of the valve guide boss 32 and is secured to a collar or plate 48 at an upper end 46 of the valve stem 42. A coil spring 50 encompasses the valve stem 42 and boss 32 with one end abutting the collar 48 and the opposite end abutting the cylinder head 22.

To operate the valve 40, a conventional arrangement such as a rocker arm is usually pivotally mounted on a bracket extending upwardly from the cylinder head 22 for rocking movement. The rocker arm conventionally has one end engaging the upper end 46 of the valve stem 42 and the other end engaged by a push rod which is suitably operated by engine-driven cam means (not shown).

To reduce wear at the point of rubbing contact between the end of the rocker arm and the end of the valve stem 42 and to lubricate the valve guide 36, oil is supplied to lubricate the various components of the valve drive train which is used to activate valves in an engine. If there is excess clearance between the valve stem 42 and the guide 36, the oil will continue to move down the stem 42 to the valve head 44. If the valve 40 controls the intake to the combustion chamber 30, the oil will be drawn in the chamber 30 and will be burned. Likewise, for an exhaust valve, the oil will be burned by the hot gases and, in either instance, cause smoke in the exhaust.

Figure 6:
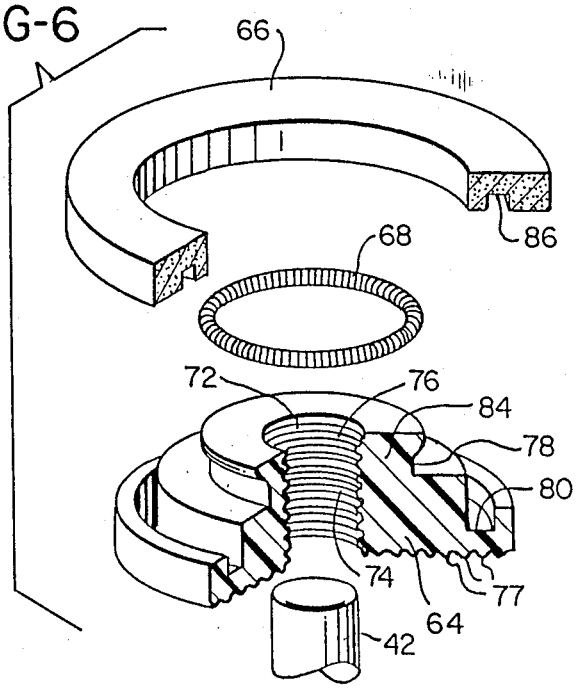
FIG. 6 is an exploded view of the valve stem seal of FIG. 2.

To prevent excess leakage of oil to the combustion area 30, a valve stem seal is provided on the valve stem 42 at the upper end of the boss 32. In the embodiment illustrated in FIGS. 2 and 6 the valve stem seal consists of a suitable elastomeric material portion 64 positioned atop the valve boss 32, an insert 66 operatively connected to the elastomeric material portion 64 for providing rigidity thereto, a garter spring 68 received in a groove 78 for inwardly biasing an internal wall 74 of the elastomeric portion 64, and a retaining member 70 to retain the elastomeric material and insert in position relative to the valve stem 42.

The annular elastomeric portion 64 has a central opening 72 (see FIG. 6) for receiving a valve stem 42. The internal wall 74 defining the central opening 72 has a series of ribs 76 on its face for frictionally engaging the valve stem 42. The elastomeric portion 64 is preferably made of viton fluorocarbon rubber.

Additionally, the surface of the elastomeric portion 64 which contacts the boss 32 also has a series of ribs 77, which seal against the top of the boss 32.

While a garter spring 68 positioned in a groove 78 is illustrated, it should be understood that inward bias could be built into the upper portion 84 of the elastomeric portion 64 during its manufacture, and the requirement for a garter spring would be eliminated.

Means are provided for reducing the amount of elastomeric material required for utilization in the valve stem seal 20. In the embodiment illustrated in FIGS. 2 and 6, this consists of the annular insert 66. The insert 66 may be formed of any suitable material, and may, for example, be constructed of stamped or powdered metal, or molded ceramic or plastic, although it will be obvious that the specific material may be varied within the scope of the invention. Regardless of the material selected, insert 66 is operatively connected to the elastomeric portion 64 by a connection means which may take the form of a slot 86 formed therein. Utilization of the annular insert 66 allows for a reduction in the amount of elastomeric material utilized without sacrificing the seal rigidity, wear resistance or other performance parameters.

Figure 8:
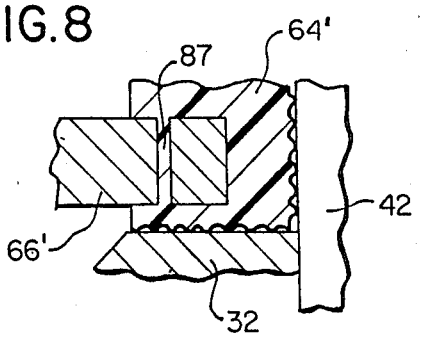
FIG. 8 is a partial cross-sectional view through an additional embodiment of the invention.

The insert is washer shaped and if constructed of molded plastic for example, could be modified to have holes formed therein, as shown at 87 in FIG. 8 of the drawings, for increasing the bond between a modified insert 66' and the material of a modified elastomeric portion 64'. Thus, the elastomeric portion 64' is molded around the insert 66' and the material of the portion 64' flows into the holes 87 of insert 66'.

Means are provided for retaining the interconnected elastomeric material portions 64, 64' and inserts 66, 66' in position on a top surface 88 of the valve guide 36 and boss 32. In the embodiments illustrated this consists of retaining member 70. The retaining member includes four distinct portions: a central, basically circular portion 90 and three leg portions 92, 94, 96. The circular portion 90 has a center cut-out portion 98 through which the valve stem 42 extends.

The three leg portions 92, 94, 96, which may be formed integrally with the retaining member 70, are preferably spaced at approximately 120° intervals about the outer periphery of the circular portion 90. Each leg portion 92, 94, 96 has stamped therein additional gripping members 100, 102. These gripping members 100, 102 engage the valve guide boss 32 and thereby retain the valve stem seal in position on top of the boss 32.

Figure 3:
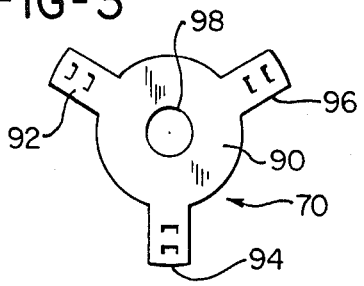
FIG. 3 is a top view of the valve retaining member after stamping.
Figure 4:
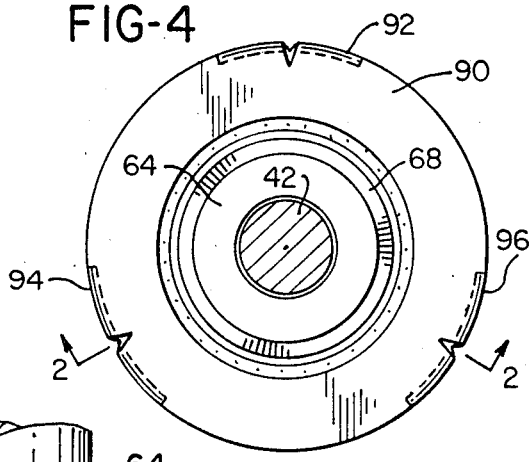
FIG. 4 is a top plan view of a valve stem seal of the present invention with a valve stem in cross section.
Figure 7:
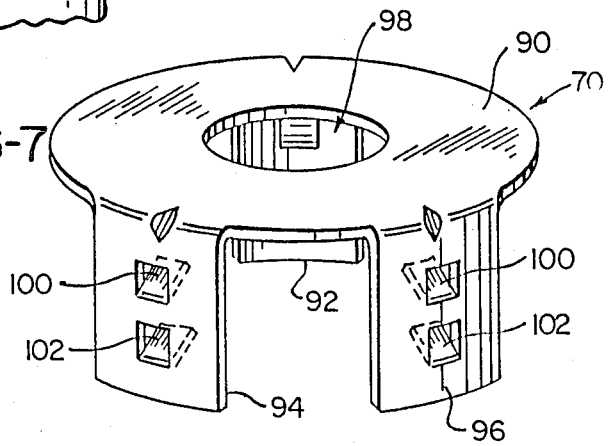
FIG. 7 is a perspective view of the retaining member of FIG. 3 in its finished configuration.

The retaining member 70 may be stamped flat, as shown in FIG. 3, and shaped for use later. The operative configuration of the retaining member 70 is with the three legs 92, 94, 96 extending in the same direction from the circular portion 90, as best illustrated in FIG. 7.

With the above-described construction, the seal will center itself on the valve stem 42 regardless of the concentricity of the boss 32 and the valve guide 36. This provides an effective oil metering device/seal while allowing for greater manufacturing tolerance in the relationship of the valve guide 36 to the boss 32.

Figure 5:
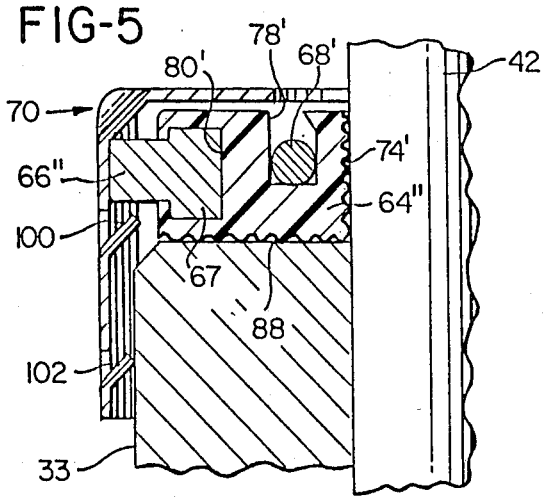
FIG. 5 is an enlarged partial cross sectional view showing an alternate embodiment of the valve stem seal of the present invention.

With reference now to FIG. 5 of the drawings, another preferred embodiment of the invention will be described. As seen in FIG. 5 an elastomeric portion 64'' is received on the upper surface 88 of the boss 32 above the side wall 33 thereof. An annular groove 78' is formed in an upper surface of the elastomeric portion 64'' and receives a garter spring 68' for biasing an internal wall 74' thereof into engagement with the valve stem 42. An insert 66'' has a T-shaped enlargement 67 received in a complementarily configured T-shaped opening 80' with portions of the insert projecting outwardly of the elastomeric portion 64''.

Figure 2:
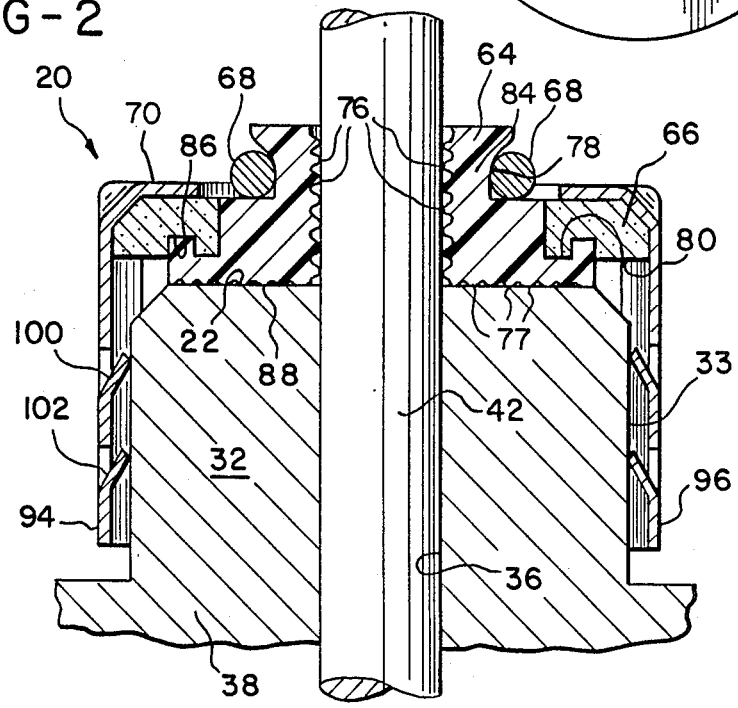
FIG. 2 is an enlarged partial vertical cross sectional view of a first embodiment of seal and valve guide boss with the valve stem shown in elevation.

The composite valve stem seal consisting of the elastomeric portion 64'', insert 66'' and spring 68' is captured between the upper surface 88 of the boss 32 and the retainer 70 which functions in the same manner described with respect to the embodiment of FIG. 2 of the drawings.

Figure 9:
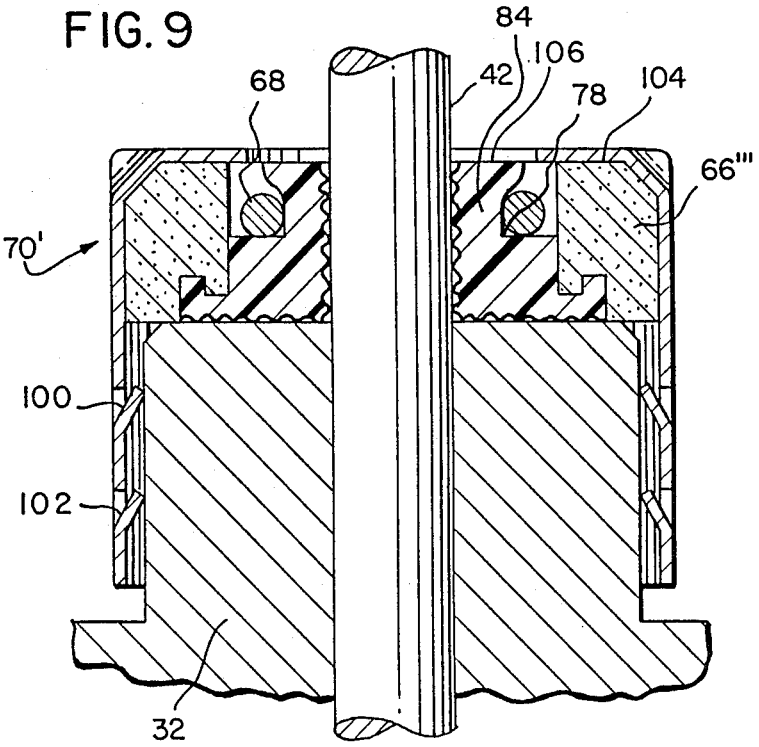
FIG. 9 shows still a further modification of the valve stem seal of the present invention.

FIG. 9 of the drawings shows a further embodiment wherein the elastomeric portion is identical to that shown at 64 in FIG. 2, but an insert 66''' is used which extends upwardly and has an upper surface 104 parallel to an upper surface 106 of elastomeric portion 64. In other respects the valve stem seal is similar to that shown in FIG. 2, except retainer 70' is somewhat deeper than retainer 70 to accommodate the increased thickness of the insert 66'''.

However, with both embodiments 70 and 70', once the entire seal body is assembled and in the operating position, as shown in FIGS. 2, 5 and 9, the insert prevents the retaining member 70 from over compressing the elastomeric portion.

While the forms of apparatus herein described constitute preferred embodiments of this invention, it is to be understood that the invention is not limited to these precise forms of apparatus, and that changes may be made therein without departing from the scope of the invention which is defined in the appended claims.

What is claimed is:

1. In combination with an engine cylinder head, valve guide boss means projecting upwardly from said cylinder head and having an upper surface and cylindrical side surface, a valve guide formed in said cylinder head, means defining an opening in said boss means substantially aligned with said valve guide, a valve stem slidably received in said valve guide and boss means opening, and a valve stem seal including an annular elastomeric portion having an internal wall defining and opening therethrough substantially aligned with said boss means opening and said valve guide and receiving said valve stem, the improvement comprising:

said elastomeric portion being seated solely on said upper surface of said boss means above said side surface thereof, means associated with an upper section of said elastomeric portion biasing said internal wall into fictional engagement with said valve stem, an annular insert formed of a rigid material relative to said elastomeric portion, said insert and an outer portion of said elastomeric portion being complementarily configured and in interlocking relationship with each other, and retaining means having a central portion, means defining an opening through said central portion and a depending, boss means-engaging portion, said retaining means being received over said boss means with said boss means-engaging portion in engagement with said boss means side wall and said elastomeric portion and insert captured between said retaining means and said boss means upper surface.

2. The combination of claim 1 wherein said complementarily configured portions of said insert and said elastomeric portion comprises a groove formed in a lower surface of said insert and an upwardly projecting wall on said elastomeric portion received in said groove and said insert.

3. The combination of claim 1 wherein said upper section of said elastomeric portion has means defining a peripheral groove therein, and said biasing means includes a spring received in said peripheral groove.

4. The combination of claim 1 wherein said complementarily configured portions of said insert and said elastomeric portion include a substantially T-shaped slot in said elastomeric portion and a T-shaped enlargement on said inner portion of said insert received in said T-shaped slot.

5. The combination of claim 1 wherein said elastomeric portion has an annular groove formed in an upper surface thereof, and said biasing means is received in said groove.

6. The combination of claim 1 wherein said boss means-engaging portion of said retaining means includes a plurality of downwardly depending legs disposed over said boss means cylindrical side surface.

7. The combination of claim 6 wherein said legs are provided with gripping means engaging said boss means side surface.

8. The combination of claim 1 wherein said elastomeric material is a fluoropolymer based elastomer.

9. The combination of claim 8 wherein said fluoropolymer base elastomer is fluorocarbon rubber.

10. The combination of claim 1 wherein said insert is formed of stamped metal.

11. The combination of claim 1 wherein said insert is formed of molded plastic.

12. The combination of claim 1 wherein said insert has means defining openings therethrough, and portions of said elastomeric portions are molded in said openings.

13. The combination of claim 1 wherein said insert is of larger diameter than said elastomeric portion.

14. A valve stem seal comprising:

at least one annular elastomeric material portion having at least two grooves formed therein and having an axially extending opening defined by an internal wall having at least one rib formed thereon;

at least one insert operatively connected to said elastomeric portion for providing rigidity to said connected elastomeric portion and said insert;

at least one garter spring positioned in one of said two grooves for inwardly biasing said internal wall towards said valve stem; and means for retaining said combined elastomeric portion and said insert in position relative to said valve stem, comprising:

a circular central portion having a centrally located cut-out portion formed therein; and at least three leg portions operatively connected to said central portion and being approximately evenly spaced about the outer periphery of said central portion and extending therefrom approximately perpendicular to the plane of said central portion in the same direction, with each of said legs having at least one gripping member formed therein.

15. A valve stem seal comprising:

an annular elastomeric member having an internal wall defining a valve stem-receiving opening therethrough, a rigid annular insert, said elastomeric member and said rigid insert having complementary portions interlocking them with each other, means biasing said internal wall of said elastomeric member radially inwardly, and retaining means for securing said interlocked elastomeric member and rigid insert in position about a valve stem.

16. The valve stem seal of claim 15 wherein:

said rigid insert extends radially outwardly of said elastomeric member.

17. The valve stem of claim 15 wherein said retaining means comprises:

a central apertured portion positioned over said elastomeric member and said rigid insert, and downwardly depending legs extending outwardly of said elastomeric member and rigid insert.

* * * * *